United States Patent [19]

Chesner

[11] 4,428,417

[45] Jan. 31, 1984

[54] HEAT EXCHANGER CLEANER

[76] Inventor: Ramon J. Chesner, 2580 Buena Vista Dr., Brookfield, Wis. 53005

[21] Appl. No.: 328,872

[22] Filed: Dec. 9, 1981

[51] Int. Cl.[3] ..... F28D 19/00; F28G 9/00

[52] U.S. Cl. ..... 165/5; 165/95

[58] Field of Search ..... 165/5, 95

[56] References Cited

U.S. PATENT DOCUMENTS 2,379,506 7/1945 Yerrick et al. ..... 165/5

2,761,653 9/1956 Grames et al. ..... 165/5

*Primary Examiner*—Albert W. Davis, Jr.

*Attorney, Agent, or Firm*—Wheeler, House, Fuller & Hohenfeldt

[57] ABSTRACT

Heat exchanger cleaner for temporary installation in a heat exchanger or similar assembly to clean the heat exchange surfaces therein wth a jet of pressurized cleaning fluid. The cleaner has an arm temporarily pivotally attached to the inside wall of the housing of the heat exchanger assembly to support a spray head. The arm is free to swing in a radial plane adjacent one end of the core assembly. A drive, preferably having its working parts positioned outside the heat exchanger housing, swings the arm at a measured rate of speed to effect radial travel of the spray head across the exposed end of the core assembly. Circumferential coverage of the core assembly is provided by rotating the core assembly within the heat exchanger housing, employing the usual core assembly drive.

The cleaner can be installed in a heat exchanger through an access opening in the housing adjacent one end of the core assembly. The swing arm of the cleaner drive can telescope to fit heat exchangers of varying diameter.

In a preferred embodiment of the invention, the drive for the swing arm includes a hydraulic cylinder which is operated by filling it from a low pressure water supply at a slow, measured fill rate which can be regulated by a needle valve and flow meter.

The preferred embodiment also includes means to periodically divert the jet of cleaning fluid to avoid contact with the radially extending end seals of the core assembly. As a result the end seals need not be removed during cleaning, contrary to prior practice.

11 Claims, 5 Drawing Figures

HEAT EXCHANGER CLEANER

TECHNICAL FIELD

The invention is an improved heat exchanger core cleaner. The invention particularly relates to a core cleaner for heat exchangers comprising a core assembly mounted for rotation within a cylindrical housing about the common axis of the housing and core.

BACKGROUND ART

Many heat exchangers of the type described above are in use for extracting heat from flue gases, such as in an electric power generation plant. The heat exchanger housings have circumferentially opposed sections, one for conducting flue gases through the core and the other for conducting air to be heated through the core. The core is rotatably driven so an element of the core is cyclically exposed first to the flue gas, then to the air to be heated, whereby heat is transferred while the hot and cold streams remain largely separated.

Apparatus designed for cleaning the cores of such heat exchangers and similar structures is well known to the art. Such core cleaners are used to periodically purge the heat exchangers of foreign matter such as fly ash corrosion, and the like that can seriously reduce the efficiency of a heat exchanger. Drive means are sometimes provided for such core cleaners to pass a nozzle or other concentrated source of pressurized cleaning fluid over one end of the core, allowing the cleaning fluid to enter and clean each passage in the core.

In heat exchangers of the type previously specified, the problem of causing a nozzle to travel circumferentially with respect to the core assembly can be solved by fixing the nozzle and rotating the core assembly with its built-in drive. But the problem remains of providing means to move the nozzle radially so that passages positioned at any radius from the central axis of the core assembly can be subjected to the action of the cleaning nozzle. The prior art has recognized this problem, but no solution to date has been completely satisfactory.

Other problems not solved by the prior art are the need in known cleaning methods to remove the end seals of the core assembly and other parts which can be damaged during cleaning; the prior need either to partially disassemble the heat exchanger to place a temporary cleaning device in it or to permanently mount a cleaning device in the hostile environment of the heat exchanger; the problem of providing a cleaning device which is adaptable for use in differently sized heat exchangers; and the problem of failure to clean each passage uniformly without wasting cleaning fluid.

SUMMARY OF THE INVENTION

A first object of the invention is to provide a simple and reliable core cleaner for use with heat exchangers of the type in which the core assembly is rotatably carried within an external housing. A second object of the invention is to provide a core cleaner which can be installed in and removed from a heat exchanger quickly and easily, particularly without removing the end seals of the core assembly. A third object of the present invention is to provide a core cleaner in which the drive for moving the nozzle radially within the housing of the heat exchanger is connected to motive means which remain outside the housing of the heat exchanger. A fourth object of the present invention is to provide a core cleaner drive which is powered by a readily available source of power, particularly a low pressure water supply. Another object of the invention is to provide an adjustable core cleaner for placement within heat exchanger assemblies having various diameters, so one core cleaner can be used for many different heat exchangers.

The core cleaner comprises an arm for being pivotally mounted at one end to the inside wall of the heat exchanger housing to swing in a radial plane adjacent one end of the core; a nozzle attached to the other end of the arm; and drive means to gradually swing the arm, thereby moving the nozzle radially with respect to the rotating core assembly and flushing each passage thereof. The drive means for swinging the arm preferably comprises a cable drive mounted outside the housing of the heat exchanger and a cable having one end attached to the cable drive and the other end attached to the arm. A preferred cable drive for use herein is a fluid operated cylinder which is filled with water at a low flow rate and pressure; the hydraulic cylinder multiplies the pressure exerted by the water and thus enables even a large and heavy arm to be swung quite easily at a predetermined rate of radial travel.

The entire core cleaner and drive can be temporarily installed within a heat exchanger assembly through the access opening normally provided in its housing, without disassembling the housing. The arm of the drive is adjustable in length, such as by providing a telescoping extension, so heat exchangers having different diameters can be cleaned by a single tube cleaner.

Finally, means can be provided to interrupt the discharge of cleaning fluid when the nozzle is directed toward a radial end seal plate, preventing damage to the plate and thus allowing the heat exchanger to be cleaned without removing the plates first.

DETAILED DESCRIPTION OF THE PREFERRED EMBODIMENT

Figure 1:
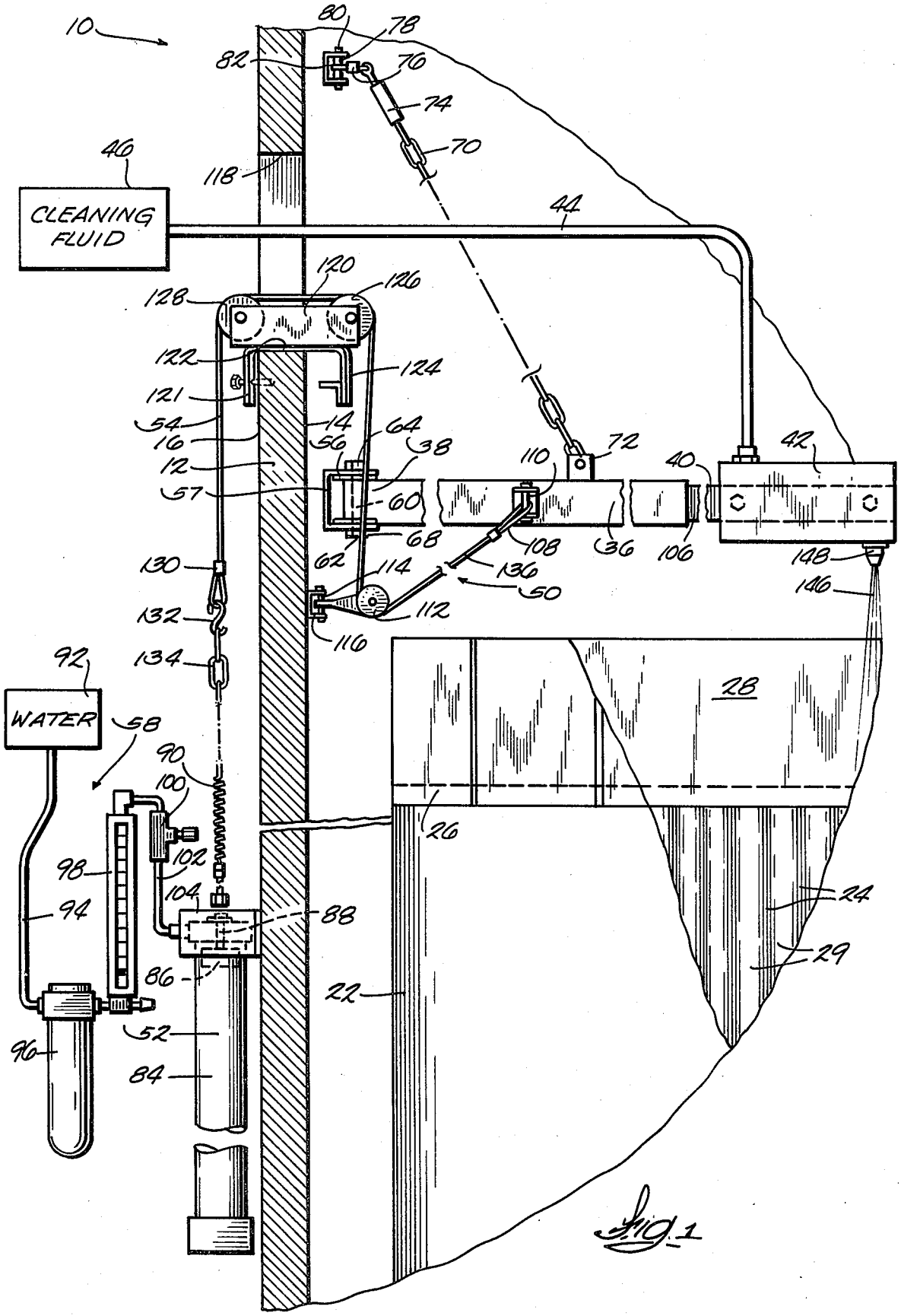
FIG. 1 is a side elevational view of two examples of the present invention, shown installed in the housing of a heat exchanger adjacent the core assembly thereof. Parts of the environment of the invention are cut away or shown in section.

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

The environment for use of the invention is a heat exchanger 10 having a generally cylindrical housing 12 with an inner wall 14, an outer wall 16, and end plates 18 and 20. Within housing 12 is a core assembly 22 comprising axially and radially extending corrugated plates 24 supported in a frame 26. The core is divided into wedge-shaped segments by radial end seals 28, and includes between plates 24 a multiplicity of passages 29 extending axially through core assembly 22 and requiring periodic cleaning. Core assembly 22 is rotatably carried within housing 12, and they are coaxial; their common axis of rotation is denoted as 32. First drive means such as motor 34 is provided to allow core assembly 22 to be continuously rotated within housing 12 while the heat exchanger is in use. This drive also facilitates cleaning of the core assembly, as will be explained below. Plenums 30 at each end of housing 12 are divided in two through their diameters by stationary seal members 31 to form circumferentially opposed chambers, respectively for conducting flue gases and air through core assembly 22.

A further explanation of the construction and function of heat exchanger 10 is not necessary here, as heat exchangers constructed as just described are known to the art.

The core cleaner of the present invention comprises an arm 36 having one end 38 pivotally attached to inner wall 14 and its other end 40 attached to a spray head 42 comprising one or more cleaning nozzles. Spray head 42 is connected via a hose 44 with a reservoir 46 of pressurized cleaning fluid. Spray head 42 is moved radially, for example from the position shown in full lines to the position shown in phantom in FIG. 3, by second drive means generally indicated as 50 comprising cable drive means 52 outside of housing 12, cable means 54 (which might conceivably be a chain or other tension member), and preferably brake means such as a friction disk 56 bearing between first end 38 and bracket 57 to resist the pull of cable 54 when it is drawn in by cable drive 52, thereby preventing the arm from wandering. Finally, motive water supply means generally indicated at 58 is provided to introduce water into cable drive 52 to draw in cable 54 at a predetermined rate.

In this embodiment of the invention the details of support of arm 36 are as follows. Arm 36 is perforated at its first end 38 to receive a pivot pin 60 having threads 62 at one end and a head 64 at the other end to capture first end 38 within the arms of a U-shaped bracket 57. A nut 68 is used to temporarily secure pin 60 in place. Although bracket 57 can be temporarily mounted on the inside wall 14 of housing 12, in a preferred embodiment bracket 57 is permanently mounted. The nut, pivot pin, and arm are all removable, so only bracket 57 is exposed to the conditions within the heat exchanger while in use. Friction disk 56 is also removable. Arm 36 is further supported by a chain or cable 70 having a first end secured by bracket 72 to arm 36, a turnbuckle 74 to adjust its effective length, and a second end shackled by clamp 76 to a tubular bar 78 mounted for rotation on a pivot pin 80 received by a second U-shaped bracket 82. Again, everything but bracket 82 is removable.

Looking now at the cable drive, drive means 52 comprises a cylinder 84 containing a piston 86 connected via piston rod 88 to a relief spring 90 in line with cable 54. Water supply means 58 supplies water from a low pressure source 92, such as an ordinary municipal or factory water supply, via conduit 94, filter 96, and flow rate indicator 98, to a needle valve 100 for controlling the flow rate. A very low flow of water, such as 2 millimeters of water per minute, can be provided to a relatively large cylinder 84 having an inside diameter of about 5 inches (a piston area of about 160 square centimeters) via a conduit 102 having a very much smaller cross sectional area. As a result of the force multiplying effect of the water drive just described, the water taken at low pressure from supply 92 can exert a great hydraulic force tending to draw in cable 54 very slowly and steadily. Cylinder 52 is held in place by a clavicle 104, which can either be temporary or permanent.

In a preferred embodiment of the invention the arm 36 has a telescoping extension 106 to allow the length of arm 36 to be adjusted to fit a particular condenser.

Looking now to the details of the running of cable 54, it has a first end 108 received in a bracket 110 fixed to arm 36, preferably to the main part of the arm. The cable is reeved around a pulley 112 which can pivot about a pin 114 carried by a third U-shaped bracket 116, which again is the only fixed part of the assembly. The cable then is guided through access opening 118 in the side of housing 12 by a pulley block 120 temporarily mounted to the lip 122 of opening 118 by a C-clamp 124. Pulley block 120 includes pulleys 126 and 128 for guiding the cable over lip 122, as a result preventing contact between the cable and housing. The other end 130 of cable 54 is attached by S-hook 132 and chain 134 to relief spring 90, which prevents minor irregularities in the motion of arm 36 from causing the cable to snap.

Figure 3:
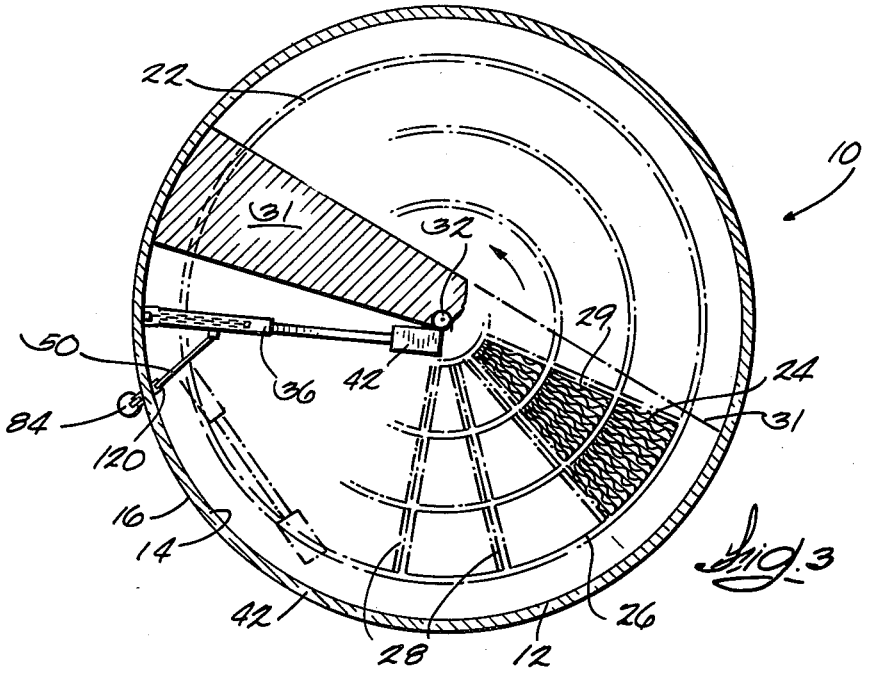
FIG. 3 is a top plan view, somewhat enlarged, of the structure shown in FIG. 2, with the top plate of the heat exchanger housing removed for greater clarity of illustration.

The operating of the device can now be explained with reference to FIG. 3. As cable 54 is drawn in, preferably by a continuous feed of water from supply 92, arm 36 continuously but very slowly swings clockwise, slowly conveying spray head 42 along the arc described by second end 40 of arm 36. Since core assembly 22 is continuously rotated by motor 34, the core assembly travels circumferentially and the spray head travels substantially radially, thus providing complete coverage of the entire core assembly 22.

With suitable sizing of the interior components, particularly arm 36, spray head 42, and the associated hardware, the assembly for driving spray head 42 can easily be passed through access opening 118 for installation into and removal from a fully assembled heat exchanger.

Figure 5:
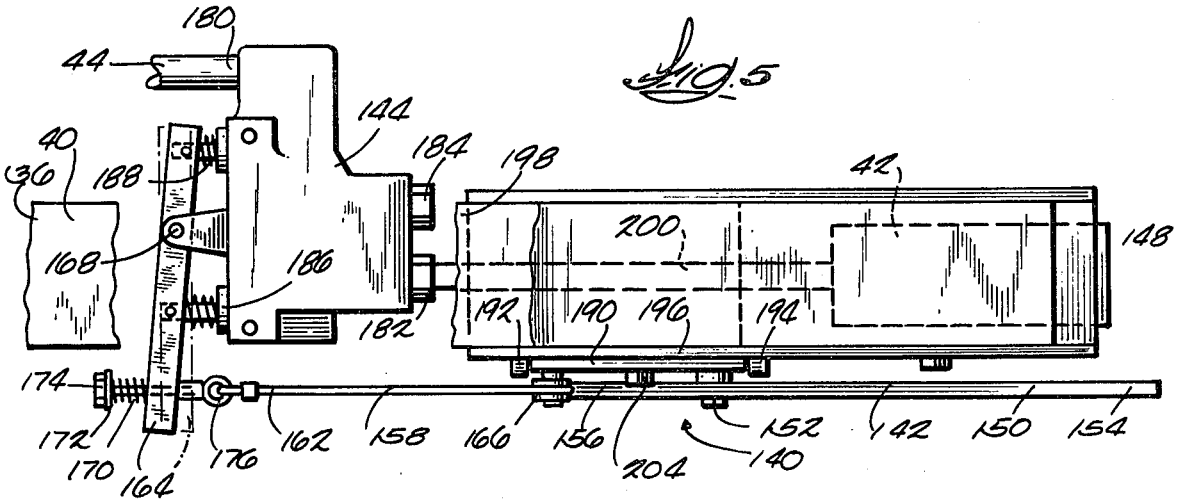
FIG. 5 is a top plan view of the structure shown in FIG. 4.
Figure 4:
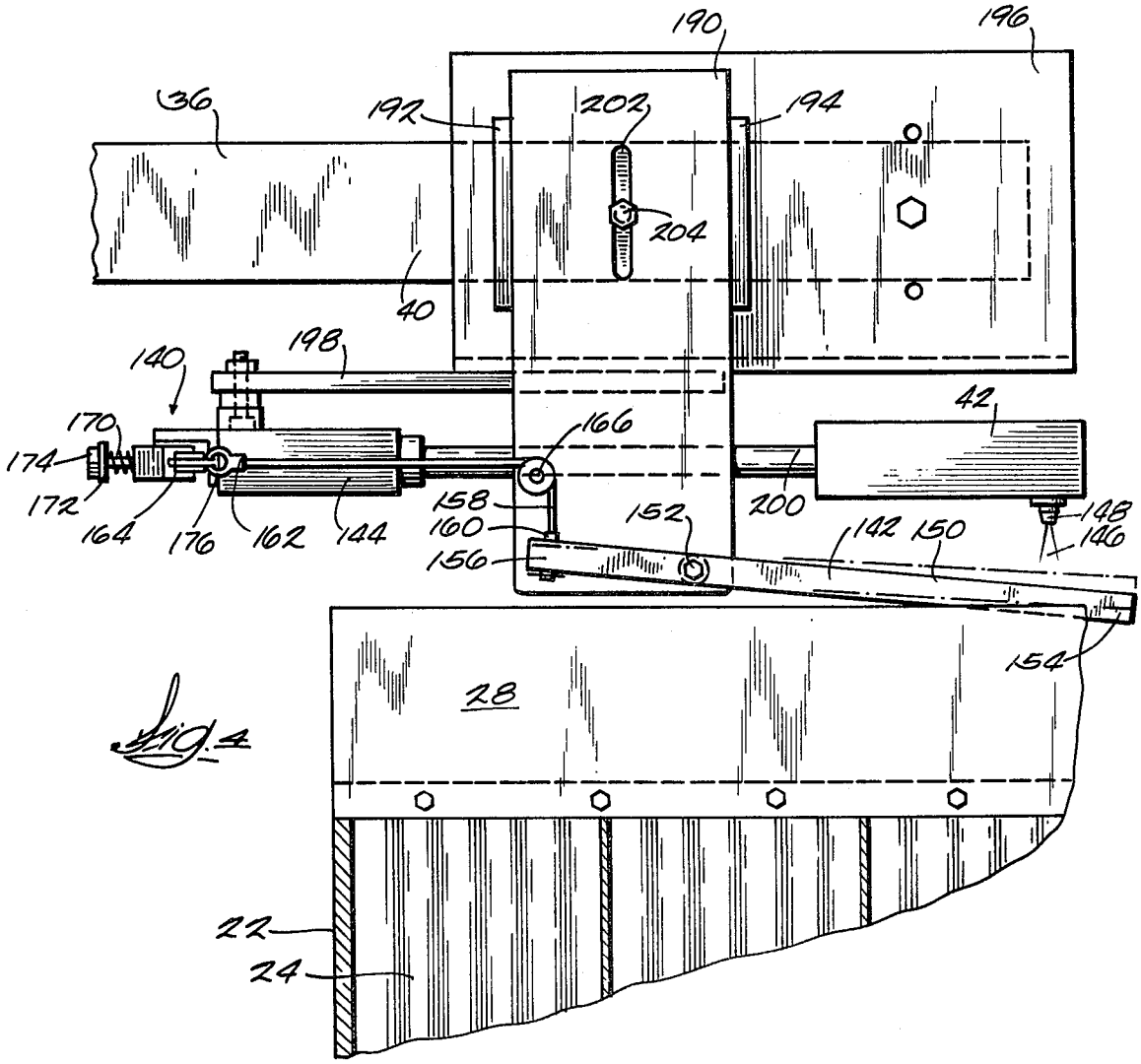
FIG. 4 is an enlarged framentary side elevational view similar to FIG. 1, showing an alternate embodiment of the invention.

Referring now to FIGS. 4 and 5, an alternate embodiment of spray head 42 is shown, including fluid control means to interrupt the jet of cleaning fluid when it is directed toward a radial end seal 28. (Although the surfaces forming passages 29 are not normally injured by the jet of cleaning fluid, radial end seals 28 are presented edgewise and directly adjacent the spray head, so the high spray pressure employed for cleaning would cut the seals 28 if it contacted them. In the past, great time, effort and expense has been required to remove, reinstall, and realign seals 28 each time the heat exchanger was cleaned.)

The fluid control means, generally found at 140, comprises a sensor 142 for detecting the proximity of an end seal member and a transfer valve 144 regulated by the sensor for selectively interrupting the jet 146 of cleaning fluid emitted from nozzle 148 during cleaning.

Sensor 142 comprises a lever 150 carried on pivot 152 adjacent spray head 42. The lever is pivoted from a first position shown in full lines to a second position shown in phantom in FIG. 5 when a radial end seal 28 moves under spray head 42 and into interference with lever 150, due to rotation of core assembly 22. When first end 154 of lever 150 is thus moved upward (if the spray is directed downward), the other end 156 of lever 150 is dropped. A cable 158 is attached at its first end 160 to lever end 156 and at its other end 162 to a rocker arm 164, and is reeved about pulley 166. Rocker arm 164 is pivotally mounted at 168. A relief spring 170 acts between rocker arm 164 and washer 172 (secured by a nut 174 threaded to eye bolt 176 to which second cable end 162 is attached). When lever 150 is raised by a seal 28 passing beneath it, lever 150 is rotated counterclockwise, and that rotation, via cable 158, moves rocker arm 164 to the position shown in phantom.

Transfer valve 144 takes cleaning fluid via hose 44 at its input 180 and allows it to leave either via outlet 182 and spray head 42 or via outlet 184 whence it is wasted; it is thus an OR logic valve. When rocker arm 164 is as shown in full lines in FIG. 5, in its rest position due to the pull of gravity on first end 154, the valve element 186 for allowing communication between inlet 180 and outlet 182 is open and the valve element 188 for allowing communication between inlet 180 and outlet 184 is closed. At this time jet 146 is being emitted from nozzle 148. When rocker arm 164 is moved to the position shown in phantom, the valve elements are reversed so the path to outlet 182 is closed and the path to outlet 184 is open, dumping cleaning fluid via outlet 184 and interrupting jet 146. When seal 28 passes, the greater length of the sensor end of lever 150 (for downwardly directed spraying only) causes lever 150 and rocker arm 164 to return to their positions shown in full lines, allowing jet 146 to resume as the valves are again reversed.

Pivot 152 and pulley 166 are mounted to a slide 190 mounted between blocks 192, 194 defining a track so slide 190 can be adjusted with respect to the frame 196 (which is connected via plate 198 to valve body 144 and thence to conduit 200 secured to spray head 42). Slide 190 has a slot 202 and a retaining nut 204 to secure slide 190 against frame 196. As a result, the trigger point for lever 150 can be set by adjusting the vertical trim of slide 190. Alternatively, the trim of turnbuckle 74 can be changed to accomplish a similar result indirectly. That expedient, however, will also change the position of nozzle 148.

Figure 2:
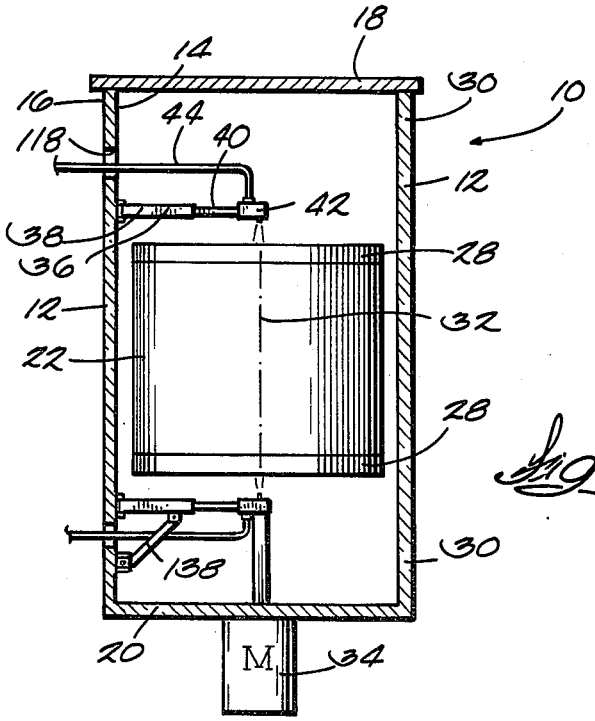
FIG. 2 is a greatly reduced view similar to FIG. 1, showing the heat exchanger assembly more clearly and showing two cleaning devices for cleaning from above and below at the same time.

As FIG. 2 illustrates, two cleaning devices as described herein can be mounted in the housing at once to simultaneously clean from each end of core assembly 22. The only differences are that chain 70 must be replaced by a rigid brace 138 or other structure for supporting arm 36 from beneath, and lever 150 cannot depend on gravity to return to its first position unless it is rearranged so that first end 154 of the lever becomes the shorter arm thereof.

I claim:

1. A core cleaner for temporary installation in a heat exchanger of the type having a generally cylindrical housing with inner and outer walls and an access opening in the inner wall, a core assembly of axially disposed heat exchange passages, said core assembly having first and second axial ends and being mounted within said housing, and first drive means for rotating said core assembly within said housing about their common axis, said core cleaner comprising:

A. a spray head for directing a jet of cleaning fluid through said core assembly;

B. an arm having a first end, pivot means for said first end, means detachably securing said pivot means to said inner wall, said arm having a second end for supporting said spray head, said arm being supported on said pivot means for swinging said spray head in a radial plane adjacent and generally parallel to one end of said core assembly;

C. second drive means having detachable securing means securing it to said inner wall, said drive means having a flexible member and means detachably connecting said flexible member to said arm to swing said arm in one direction in said plane for moving said spray head radially with respect to said core assembly; and D. secure quickly operable fasteners securing said quickly detachable means to said inner wall when it is desired to operate said core cleaner and quickly detachable when it is desired to operate said heat exchanger without said core cleaner whereby said core cleaner is not exposed to normal operations of said heat exchanger;

whereby rotation of said core assembly to said first drive means and simultaneous radial travel of said spray head effected by said second drive means causes said spray head to dispense said cleaning fluid to each passage in said core assembly.

2. The core cleaner of claim 1, wherein said second drive means comprises cable drive means; cable means having a first end attached between the ends of said arm and a second end attached to said cable drive means; and brake means in the pivotal mounting of said arm for resisting the pull of said cable drive means.

3. The core cleaner of claim 2, further comprising mounting means on said outer wall for supporting said cable drive means outside said housing, whereby to draw said cable means through an access opening in the wall of said housing to swing said arm.

4. The core cleaner of claim 3, wherein said cable drive means comprises a fluid driven piston confined within a cylinder, piston rod means to secure the second end of said cable means to said piston, mounting means to secure said cylinder in place, and fluid supply means to introduce a fluid into said cylinder for moving said piston in said cylinder.

5. The core cleaner of claim 4, wherein said fluid supply means comprises a low pressure source of water.

6. The core cleaner of claim 1, wherein said arm telescopes to permit installation is a variety of differently sized heat exchangers.

7. A core cleaner for a heat exchanger of the type having a generally cylindrical housing with inner and outer walls, a core assembly of axially disposed heat exchange passages, said core assembly having first and second axial ends and being mounted within said housing, and first drive means for rotating said core assembly within said housing about their common axis, said core cleaner comprising:

A. a spray head for directing a jet of cleaning fluid through said core assembly;

B. an arm having a first and pivotally mounted to said inner wall and and a second end for supporting said spray head, said arm being supported for swinging said spray head in a radial plane adjacent and generally parallel to one end of said core assembly; and C. second drive means to swing said arm in said plane for moving said spray head radially with respect to said core assembly;

whereby rotation of said core assembly by said first drive means and simultaneous radial travel of said spray head effected by said second drive means causes said spray head to dispense said cleaning fluid to each passage in said core assembly, and wherein said spray head includes fluid control means to interrupt said jet when said spray head is directed toward an end seal member of said fin assembly.

8. The core cleaner of claim 7, wherein said fluid control means comprises a sensor for detecting the proximity of an end seal member and a transfer valve regulated by said sensor for selectively interrupting said jet.

9. The core cleaner of claim 8, wherein said sensor comprises a lever pivotally mounted adjacent said spray head for being pivoted from a first position to a second position by a proximate end seal member and a valve operator linked to said lever and to said transfer valve for operating said valve to interrupt said jet when said lever is pivoted to said second position.

10. The core cleaner of claim 9, wherein said lever is biased to return to said first position.

11. The core cleaner of claim 7, wherein said transfer valve comprises an inlet for being connected to a source of cleaning fluid, a first outlet communicating with said spray head, a second outlet for dumping cleaning fluid, and a movable element for directing the flow of said cleaning fluid to a selected one of said outlets.

* * * * *

UNITED STATES PATENT AND TRADEMARK OFFICE

CERTIFICATE OF CORRECTION

PATENT NO. : 4,428,417

DATED : January 31, 1984

INVENTOR(S) : Ramon J. Chesner

It is certified that error appears in the above—identified patent and that said Letters Patent is hereby corrected as shown below:

Claim 1, Column 6, Line 18, "to" should read --by--

Claim 6, Column 6, Line 44, "is" should read --in--

Signed and Sealed this

*Thirtieth* Day of *October 1984*

[SEAL]

*Attest:*

GERALD J. MOSSINGHOFF

*Attesting Officer*

*Commissioner of Patents and Trademarks*